United States Patent [19]

Treiber

[11] 4,093,040

[45] June 6, 1978

[54] SILENCER AND COOLER FOR PUMP UNIT

[76] Inventor: Kenneth L. Treiber, 1103 Villamay Blvd., Alexandria, Va. 22307

[21] Appl. No.: 753,149

[22] Filed: Dec. 21, 1976

[51] Int. Cl.[2] ..... F01N 7/00; F01N 7/14

[52] U.S. Cl. ..... 181/252; 181/257; 181/262; 181/264

[58] Field of Search ..... 181/247, 264, 259, 262, 181/263, 256, 257, 258, 252, 270

[56] References Cited

U.S. PATENT DOCUMENTS

| | | | |
|---|---|---|---|
| 1,217,021 | 2/1917 | Lebedeff | 181/263 |
| 1,821,688 | 9/1931 | Bourne | 181/264 |
| 1,877,567 | 9/1932 | Erbes | 181/270 X |
| 2,809,813 | 10/1957 | Fletcher | 181/259 X |

FOREIGN PATENT DOCUMENTS

| | | | |
|---|---|---|---|
| 1,368,802 | 6/1964 | France | 181/259 |

*Primary Examiner*—Donald G. Kelly
*Attorney, Agent, or Firm*—Nathan Edelberg

[57] ABSTRACT

A silencing and cooling system for engine exhausts. The system utilizes a silencer body having an axial passage containing barriers, deflectors, and guide vanes. Cooling air enters via an axial inlet at one end and mixes with exhaust gases entering the axial passage from a lateral opening in the body as they travel to the outlet at the other end of the axial passage.

3 Claims, 2 Drawing Figures

SILENCER AND COOLER FOR PUMP UNIT

GOVERNMENT USE

The invention described herein may be manufactured, used, and licensed by or for the Government for Governmental purposes without the payment to me of any royalties thereon.

BACKGROUND OF THE INVENTION

Large industrial and military engines of the internal combustion or gas turbine type produce a stream of exhaust gases that is both loud and hot. Accordingly, there has long been a need for systems to reduce the noise and temperature levels of the stream emerging from the exhaust line.

Prior art attempts to overcome the problem of exhaust noise have used flow diverting baffles as shown, for example, in U.S. Pat. Nos. 1,395,920 and 2,101,389, as well as 3,507,356 which also uses sound absorbing material to construct the baffles and line the passage. Furthermore, attempts have been made to use a source of air to lower the temperature of the exhaust gases as in U.S. Pat. No. 3,735,594 and to carry them to a remote locale as in U.S. Pat. No. 1,331,649.

SUMMARY OF THE INVENTION

This invention relates to exhaust silencing and cooling systems for engines and is comprised of a silencing and cooling unit suitable for mounting on top of the apparatus housing which contains the engine. The exhaust gases enter the unit through a lateral inlet where they are mixed with cooling air and sound attenuated as they pass through a series of barriers, deflectors, and guide vanes to the outlet.

The unit as a whole is designed so as to be easily constructed and adapted to various engines without the need for modifying the apparatus to which it is attached.

DETAILED DESCRIPTION OF THE PREFERRED EMBODIMENT

Figure 1:
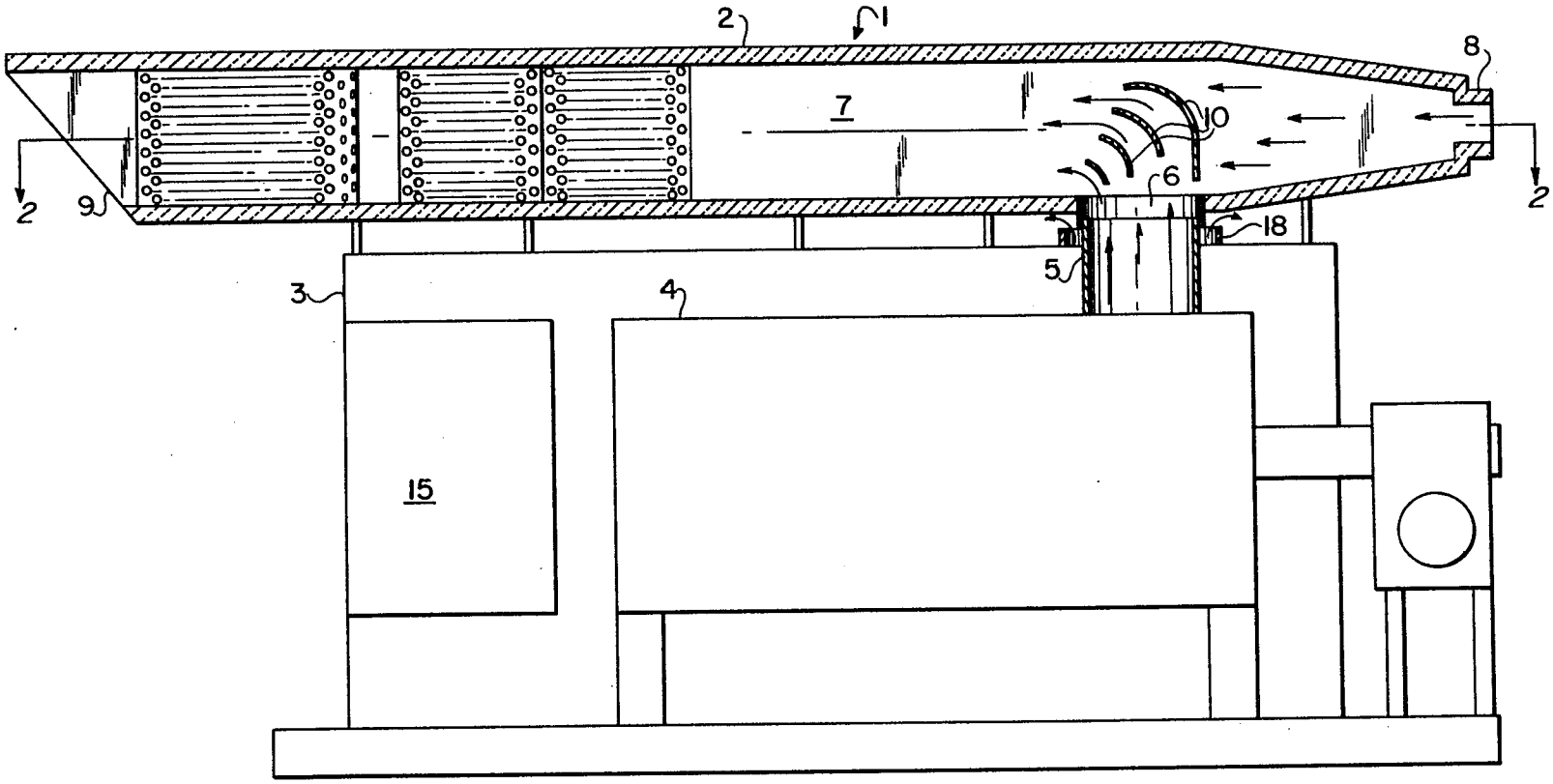
FIG. 1 is a partly schematic vertical cross-sectional view of a preferred embodiment exhaust silencing and cooling unit mounted to an engine driven pumping apparatus.

With reference to FIG. 1, there is shown an exhaust cooling and silencing unit, indicated generally by the numeral 1, which is suitable for use with any number of engines or engine-driven apparatus. The body 2 of the silencing and cooling unit 1 is mounted to the housing 3 enclosing the schematically illustrated engine 4 in a manner such that the exhaust line 5 engages a lateral inlet 6 in the body member 2.

Figure 2:
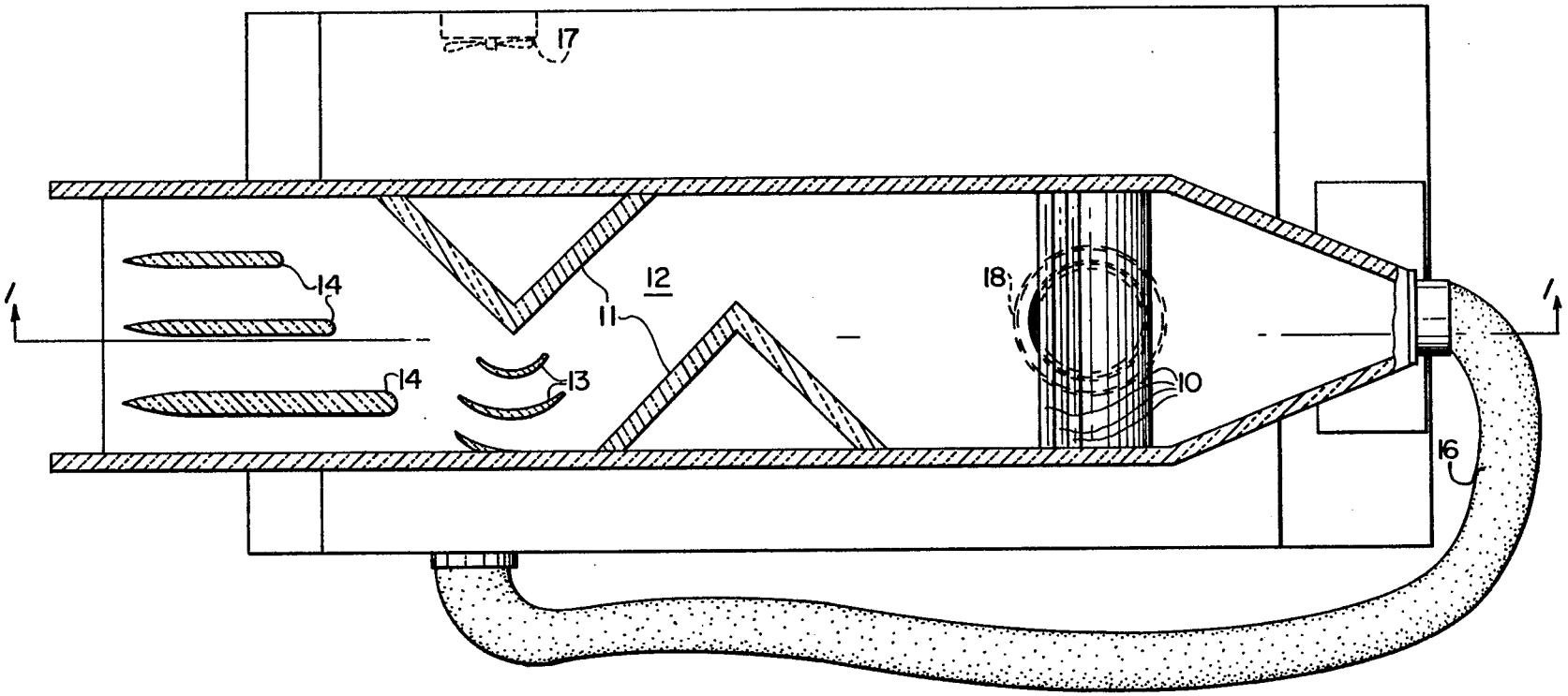
FIG. 2 is a cross-sectional view taken along line 2—2 of FIG. 1.

The body member 2 has an axial passage 7 extending from an inlet 8 at one end to an outlet 9 at the other end. Positioned above inlet 6 within passage 7 are a series of arcuate exhaust gas deflectors 10 which direct the laterally entering exhaust gases axially along passage 7. As best seen in FIG. 2, a pair of wedge-shaped barriers 11 is mounted within passage 7 downstream of the deflectors 10 so as to create an obliquely directed flow path 12 within passage 7. At the downstream end of path 12 is a second series of deflectors 13 which redirect the flow into a generally axial direction between a set of sound dampening guide vanes 14 and out from opening 9.

The cooling and silencing unit 1 is designed such that it can be inexpensively manufactured in any sheet metal shop; yet it is adaptable to use with various engines without requiring modification of the engine or the apparatus of which the engine forms a part. The walls of the body 2, as well as the barriers 11 and guide vanes 14, are a double wall construction formed of sheet stock. The walls exposed to passage 7 are perforated, and the space between the double walls is filled with a sound dampening and heat insulating material such as fiberglass. It should be noted that the perforations in the walls of passage 7 have been omitted from FIG. 1 (which is taken along line 1—1 of FIG. 2) to prevent confusion and, if solid insulation materials are used instead of fiberglass, the perforated inner wall can be eliminated entirely.

It has been found that the effectiveness of an exhaust silencing and cooling unit is, in part, a function of the rate at which the exhaust from the engine exits from exhaust line 5. Accordingly, the unit 1 is constructed such that the barriers 11, deflectors 13, and vanes 14 can be repositioned relative to each other and/or additional barriers and deflectors added. In this manner the silencing and cooling unit can be adapted to various sizes and types of engines without the need for modifying the engine or apparatus of which it forms a part. The particular configuration shown has proven satisfactory in use with a gas turbine driven pump unit producing an exhaust flow of 800° F. gases at 17,500 cubic feet per minute.

As previously noted, the silencing and cooling unit body 2 has an axial inlet 8 for supplying cooling air to passage 7. A positive displacement blower, schematically illustrated at 15, supplies the air with sufficient pressure to cause the air and gases to flow to outlet 9 as they expand and cool. It has been found, for example, that the temperature of the above noted turbine exhaust will be reduced by 400° F. by the time it reaches outlet 9 with an air supply of 35,000 cubic feet per minute. The blower 15 can be external to the apparatus having the exhaust generating engine, or it may serve as part of such an apparatus. For example, if the engine is a gas turbine, the positive displacement blower may be associated with first stage air filter, or if the engine is an air cooled internal combustion engine, air may be supplied by its cooling fan or blower. Air from the blower 15, regardless of the form it may take, may be supplied to inlet 8 by any suitable conduit 16 connected between them.

In apparatus enclosed by a housing 3 which is either ventilated or has an oil cooler utilizing a fan such as represented by the numeral 17, additional cooling of the exhaust can be achieved by providing a circumferential gap between the exhaust line 5 and the housing 3. In this manner ambient air will be brought into the housing 3 by cooling air fan 17 and will be caused to exit through gap 18, thereby lowering the temperature of the exhaust by passing about the exhaust line 5 and along the exterior of the silencing and cooling unit 1.

Having described a preferred embodiment of the invention, it is apparent that the invention represents an inexpensive solution to the problems attributable to the exhausts of heavy industrial and military engines; and, while it is simple in construction, it is readily suited for use with a variety of engine types and sizes without modification of the apparatus of which it forms a part.

I claim:

1. An exhaust silencing and cooling system for engines comprising:

a silencing and cooling unit having a axial passage therethrough, said passage having a first inlet for cooling air at one end, an outlet for cooled exhaust gases at the opposite end, and a second laterally directed exhaust gas inlet disposed between said first inlet and said outlet;

means for connecting said first inlet to a source of cooling air, and means for connecting said second inlet to the exhaust line of an engine;

first gas deflector means for directing laterally entering exhaust gases axially along said passage;

at least one pair of oppositely directed wedge-shaped barriers spaced so as to create an obliquely directed flow path located downstream of said first gas deflector;

a second deflector means located at the downstream end of said flow path for redirecting gases leaving said flow path into a generally axial direction; and axially directed sound dampening guide vanes downstream of said second deflector means.

2. The exhaust silencing and cooling system of claim 1 wherein the walls of said body forming said axial passage are comprised of a sound dampening and heat insulating material.

3. The exhaust silencing and cooling system of claim 2 wherein the portions of said barriers and vanes exposed to said gases in said axial passage are formed of a sound dampening material.

* * * * *